United States Patent [19]

Meyer

[11] 4,018,205

[45] Apr. 19, 1977

[54] ARCHERY BOW WITH ARCUATE LIMB ATTACHMENTS

[76] Inventor: Leonard S. Meyer, 6449 Bridgewood Road, Columbia, S.C. 29206

[22] Filed: Dec. 18, 1975

[21] Appl. No.: 642,128

Related U.S. Application Data

[62] Division of Ser. No. 278,932, Sept. 8, 1972, Pat. No. 3,965,883.

[52] U.S. Cl. ..... 124/24 R; 260/830 R; 124/23 R

[51] Int. Cl.[2] ..... F41B 5/00

[58] Field of Search ..... 124/23 R, 24 R, 22, 124/35 A, 41 R; 273/DIG. 7, DIG. 3, DIG. 6, DIG. 9

[56] References Cited

UNITED STATES PATENTS 3,502,063 3/1970 Bear ..... 124/23 R

FOREIGN PATENTS OR APPLICATIONS 50,457 9/1966 Germany ..... 124/23 R

*Primary Examiner*—Richard J. Apley
*Assistant Examiner*—William R. Browne
*Attorney, Agent, or Firm*—Synnestvedt & Lechner

[57] ABSTRACT

An archery bow is disclosed having a handle section and bow limbs with arcuate configurations connected to the belly or compression side of the bow. Each bow limb is presented away from each other. A nock is provided at each end of each limb to receive a bow string. Embodiments are also disclosed providing for adjustment of the recurved limbs with respect to the handle section of the bow.

4 Claims, 35 Drawing Figures

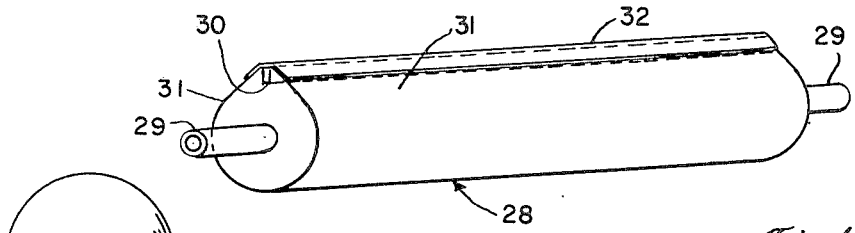
Fig. 12.
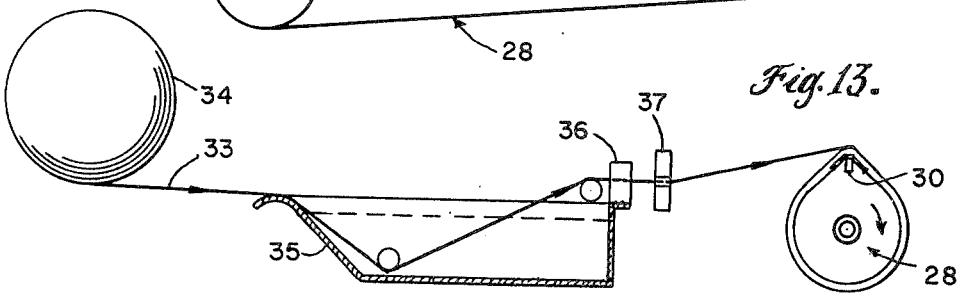
Fig. 13.
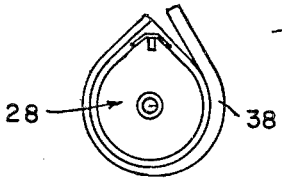
Fig. 14.
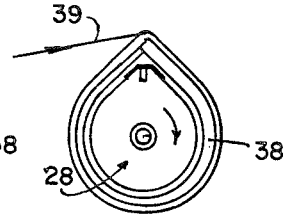
Fig. 15.
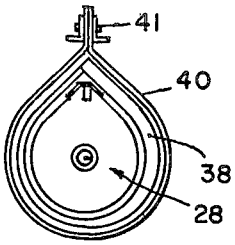
Fig. 16.
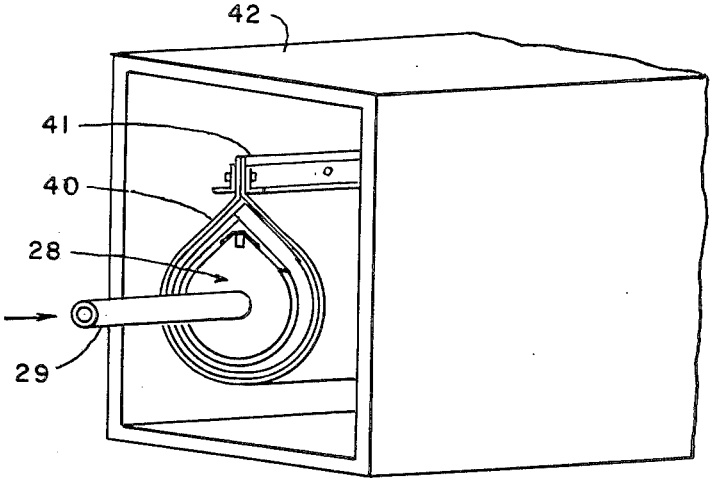
Fig. 17.
Fig. 18.
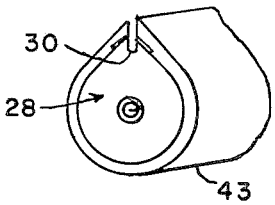
Fig. 19.
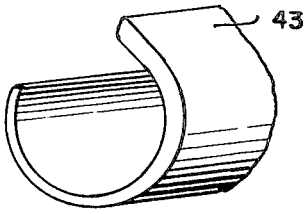
Fig. 20.
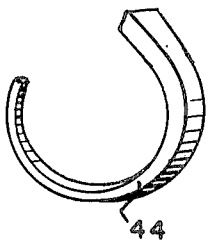

ARCHERY BOW WITH ARCUATE LIMB ATTACHMENTS

This is a division of application Ser. No. 278,932, filed Aug. 9, 1972, now Pat. No. 3,965,883, This invention relates to archery bows and is concerned with providing a bow having an unusually favorable combination of characteristics, including efficiency (arrow speed vs. pull force), ease of handling (short length), shooting comfort (minimum shock to arms when arrow is released), twist resistance, and production ease.

BACKGROUND AND STATEMENT OF OBJECTS

Because of the nature of the improvements herein contemplated, a statement describing the major known prior art bows will be helpful. For this purpose certain of those prior art bows are also illustrated in the drawings, i.e., in FIGS. 1*a* to 4*b* inclusive, which Figures are briefly described, as follows:

FIGS. 1*a* and 1*b* are views of an ancient known oriental bow, FIG. 1*a* showing the bow without its string and FIG. 1*b* showing the bow with the string applied;

FIGS. 2*a* and 2*b* are views of the well known midieval long bow, FIG. 2*a* showing the bow without its string and FIG. 2*b* showing the bow with the string applied;

FIGS. 3*a* and 3*b* are views of a recurved hunting bow, FIG. 3*a* showing the bow without the string and FIG. 3*b* showing the bow with the string applied; and FIGS. 4*a* and 4*b* are views of a currently used target bow, FIG. 4*a* showing the bow without its string and FIG. 4*b* showing the bow with the string applied.

The foregoing prior art bows may briefly be described as follows:

The oriental bow of FIGS. 1*a* and 1*b* was made of a wood-cored sandwich of parallel sinew fibers laminated on the tension back, and horn laminated on the compression belly. This provided an easy to handle, very short (40 inches or less) bow which had inherently fast string return and excellent efficiency, capable of an 800 yard cast. An important factor contributing to the bow efficiency is the recurved or bending backward of the limb ends which results in shortening of the bow string as it is released, thereby increasing the arrow speed. This bow had nonworking recurves, and the extent of recurvatuve as measured between the string line and the axis of each bow limb was about 30° to 40°. A typical 30° recurve being shown in FIG. 1*b*.

It is here noted that in FIG. 1*b* and in all cases shown and described in this application, the angular extent of recurvature is given with the bow in strung condition.

The bow of FIGS. 1*a* and 1*b* was subject to various disadvantages including the fact that in order to avoid even slight twisting of the bow limbs (which invariably) destroys the bow limbs) they were made very rigid and non-working, i.e., they did not flex in use. This rigidity resulted in excessive shock in the bow handle and thus to the archer. Moreover the horn and sinew construction was highly sensitive to temperature and humidity changes.

Although the midieval long bow of FIGS. 2*a* and 2*b* was easily produced from abundant materials, i.e., selected woods, and was an easy to shoot weapon, it was, nevertheless, of relatively low efficiency and was unwieldy (about 6 feet) in order to withstand breaking stresses. The limbs had no recurvature and the bow was also sensitive to temperature and humidity changes.

The more modern bows shown in FIGS. 3*a* and 3*b* and 4*a* and 4*b* are commonly made of a wood core-glass fiber reinforced plastic sandwich. The recurved hunting bow of FIGS. 3*a* and 3*b* was rather short, i.e., from about 48 to 60 inches. These are efficient hunting weapons almost unaffected by environmental changes. The materials available for construction, allow the use of moderately (for instance approaching 45°) recurved limbs of some flexibility so that they are in effect "semi-working". Some shock to the archer remains in the curved hunting bows, but this is not a serious problem to a hunter who shoots relatively seldom.

The modern target bow of FIGS. 4*a* and 4*b* combines the short semi-working recurved light weight limbs of the hunting bow with a heavy, elongated handle section, this results in a longer bow (60 to 72 inches) and the heavy handle helps to absorb most of the shock, so that tournament archers may shoot frequently without excessive fatigue. In addition it is known with target bows to add certain weights or stabilizer rods positioned to further absorb vibration. The design of the target bow, however, is such that it is heavy and unwieldy so that it is difficult to hold up at arms length for extended periods of time.

Although the use of recurved limbs is advantageous in increasing the efficiency of the bow, the recurved limbs tend to twist, particularly if the recurve is of substantial magnitude. In view of this, the recurve heretofore employed has been distinctly limited (for instance to about 25° as indicated in FIG. 4*b*), and bows with recurved limbs have frequently been subject to highly undesirable twisting, in many instances even resulting in destruction of the bow limb.

It is a principal objective of the present invention to provide a bow having limbs which are highly recurved, but in which the tendency to twist is extensively diminished. This is accomplished by utilization of certain materials in the fabrication of the bow limbs having greater elongation and lower Young's modulus of elasticity, than the materials heretofore commonly utilized in archery bows. At the same time the bow limbs are increased in thickness thereby extensively increasing the twist resistance so that the limbs may be highly recurved without developing appreciable twisting tendency.

A further object of the invention is to provide elevated string guides mounted on the recurved limbs and arranged to further assist in overcoming the tendency of recurved limbs to twist. Such elevated string guides may be employed to advantage upon recurved limbs of any degree of recurvature, but they are particularly advantageous with highly recurved limbs of the kind contemplated according to the present invention.

A still further objective of the invention is to provide a bow construction in which the recurved limbs are separately formed and mounted upon the handle section of the bow. Provision is thus made for convenient fabrication of the bow limbs and of the handle section respectively from materials having different characteristics.

In accordance with another aspect of the invention, provision is made for adjustably mounting the separately formed bow limbs, thereby providing for adjustment of the characteristics of the bow.

BRIEF DESCRIPTION OF FIGURES ILLUSTRATING THE INVENTION

How the foregoing objects and advantages are attained will appear more fully from the following description referring particularly to FIGS. 5*a* to 21, which are briefly described as follows:

FIGS. 5*a*, 5*b* and 5*c* are views illustrating a bow construction in accordance with the present invention, FIG. 5*a* showing the bow alone, FIG. 5*b* showing the same bow with the bow string applied and FIG. 5*c* showing the bow with an arrow applied to the string and with the string drawn in preparation for shooting;

FIGS. 5*d* and 5*e* are enlarged detailed views illustrating the elevated string guide employed in the embodiment of FIGS. 5*a*, 5*b* and 5*c*, FIG. 5*d* being taken as indicated by the line 5*d*—5*d* applied to FIG. 5*c;*

FIGS. 6*a*, 6*b* and 6*c* are views similar to FIGS. 5*a*, 5*b* and 5*c*, but illustrating a modified form of bow according to the present invention;

FIG. 7 is a view of a bow of the general type shown in FIGS. 5*a*, 5*b* and 5*c*, but in which the recurved bow limbs are formed as separate elements connected with the handle section;

FIGS. 8*a* and 8*b* illustrate a bow of the type shown in FIGS. 6*a*, 6*b* and 6*c*, having separately formed recurved bow limbs, the limbs here being shown as mounted on the handle section of the bow in one position in FIG. 8*a* and in another position in FIG. 8*b;*

FIGS. 9*a* and 9*b* are views similar to 8*a* and 8*b*, but illustrating the applicability of recurved bow limbs of the invention to handle sections of different length;

FIGS. 10*a* and 10*b* are views illustrating another sense of adjustment of the bow limbs with respect to the handle section, according to which the angular position of the bow limbs (and the effective degree of recurve) with respect to the handle section may be adjusted;

FIGS. 11*a* and 11*b* are comparative views of another system providing for angular adjustment of bow limbs (and the effective degree of recurve) with respect to the handle section;

Method and equipment for producing highly recurved bow limbs according to the invention is illustrated in FIGS. 12 to 20 inclusive, which may briefly be described as follows:

FIG. 12 is an isometric view of a mandrel adapted to be employed in a filament winding operation in producing bow limbs according to the invention;

FIG. 13 is a diagrammatic view illustrating a filament winding operation using the mandrel of FIG. 12 and showing the application to the mandrel of resin impregnated fibrous strands;

FIGS. 14, 15 and 16 are end views of the mandrel showing different steps in the manufacture of the bow limbs;

FIG. 17 is a view illustrating a resin curing step employed;

FIG. 18 is a fragmentary isometric view illustrating a step in the separation of the formed article from the mandrel;

FIG. 19 is a fragmentary isometric view of the formed article after removal from the mandrel; and FIG. 20 is an isometric view of an individual bow limb cut from the article illustrated in FIG. 19.

Figure 21:
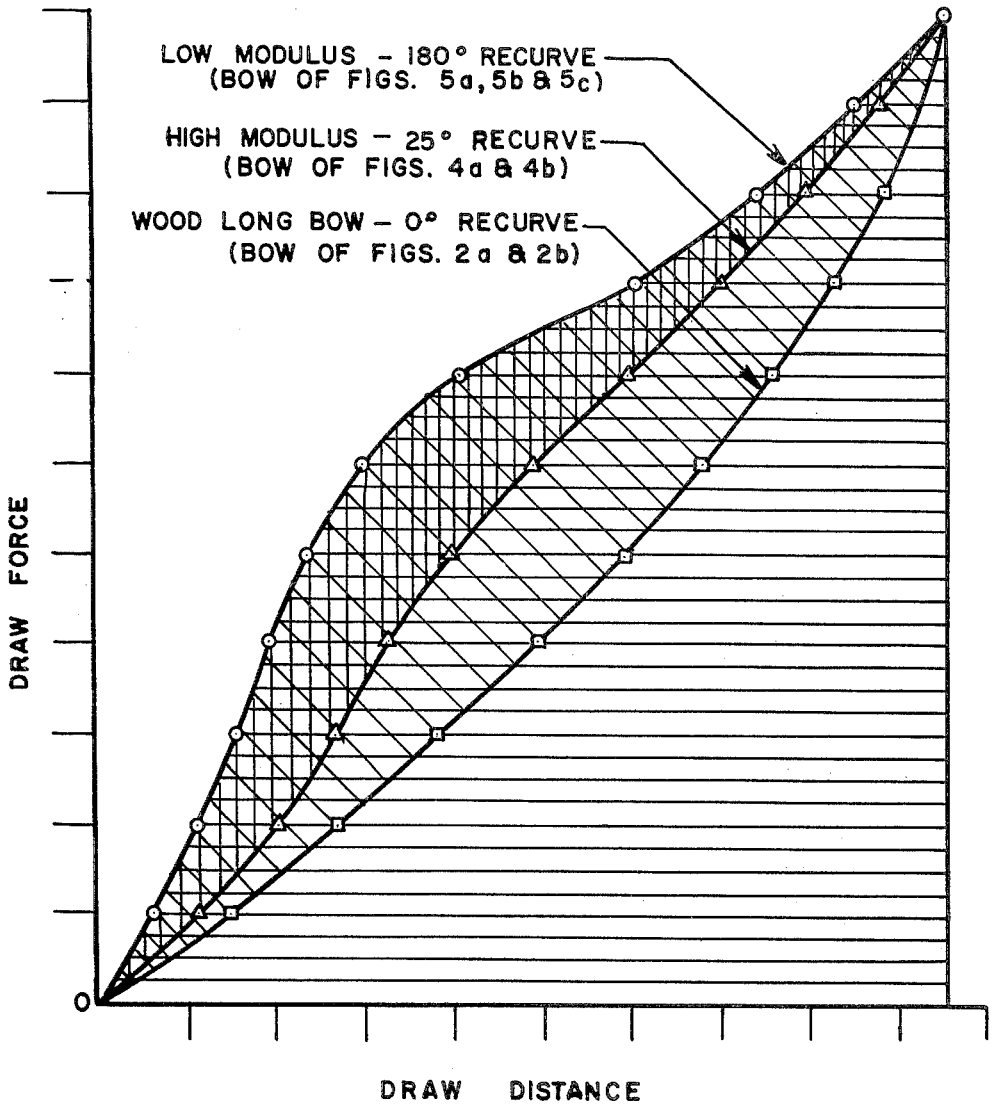

In addition to the foregoing figures the drawings still further include FIG. 21 which is a graph illustrating forcedraw curves comparing a bow according to the present invention with two prior art bows as will be explained more fully hereinafter.

DESCRIPTION OF BOWS

Figure 5A:
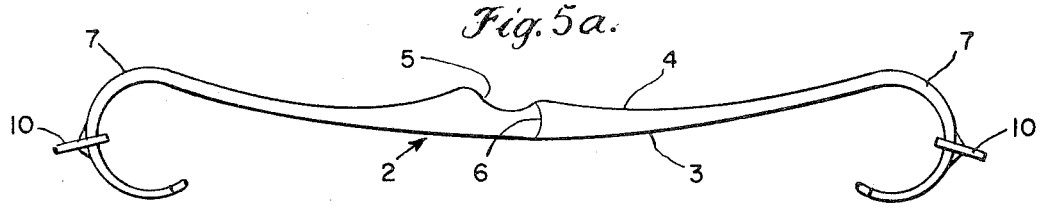
Figure 5B:
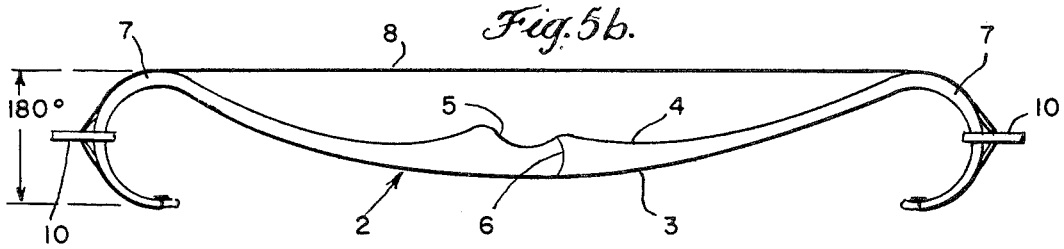
Figure 5C:
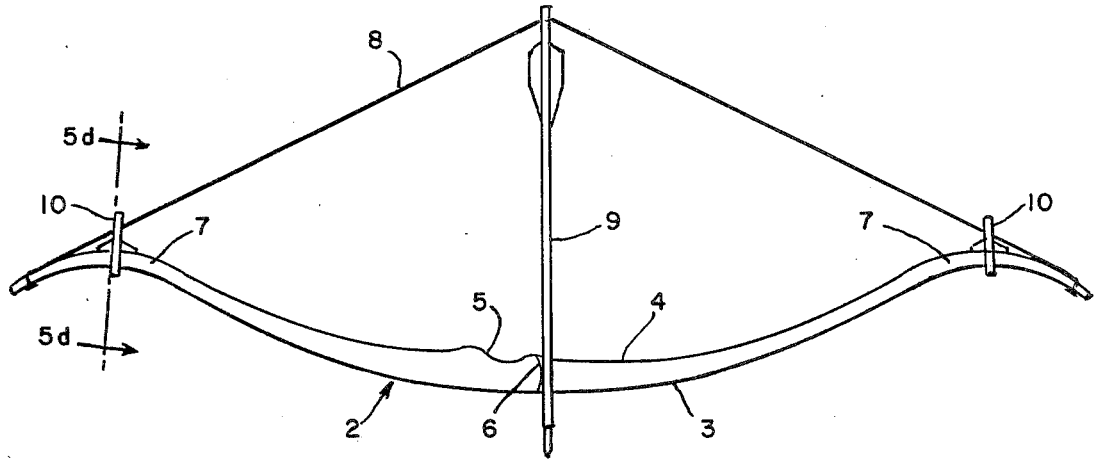
Figure 5D:
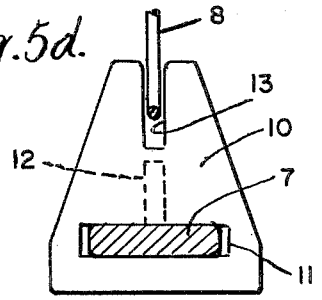
Figure 5E:
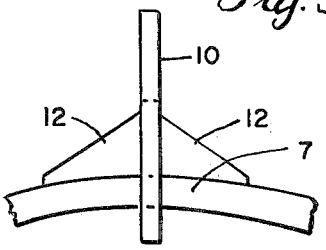

In FIGS. 5*a*, 5*b* and 5*c*, and 6*a*, 6*b* and 6*c* two general forms of bow constructed according to the present invention are illustrated. In FIGS. 5*a*, 5*b* and 5*c* the recurved limbs of the bow project from the front or tension side of the handle section and in FIGS. 6*a*, 6*b* and 6*c* the recurved limbs project from the rear or compression side of the handle section. It will further be noted by way of comparison of the two general forms of bow construction that with the bow of FIGS. 5*a*, 5*b* and 5*c* the concave sides of the recurved limbs are presented toward each other, whereas with the bow of FIGS. 6*a*, 6*b* and 6*c* the concave sides of the recurved limbs are presented away from each other.

Figure 6A:
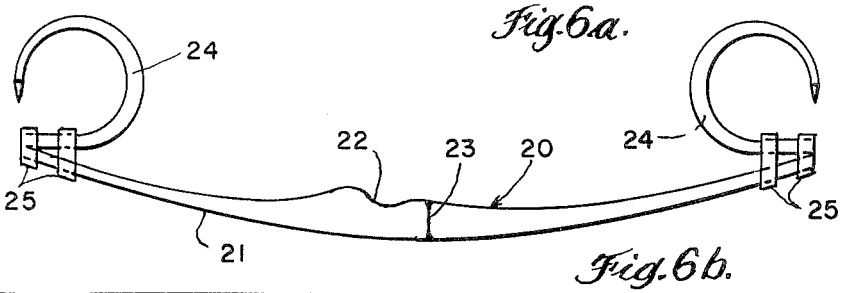
Figure 6B:
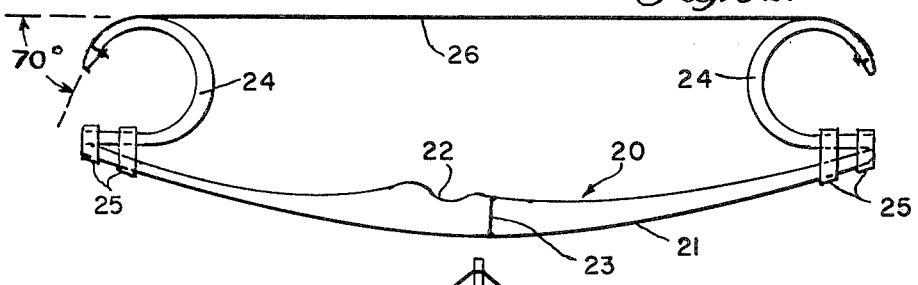
Figure 6C:
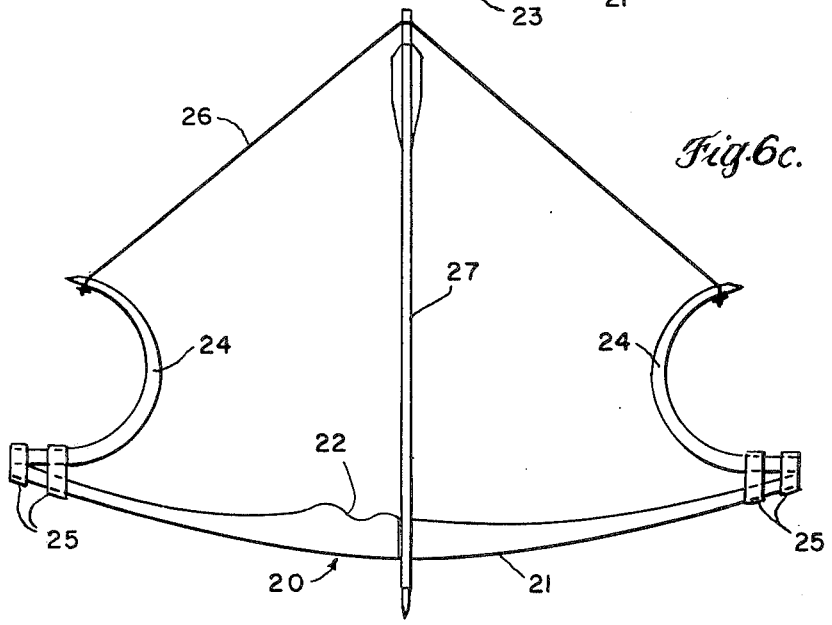

The bow of FIGS. 5*a*, 5*b* and 5*c* is also capable of being constructed with a higher degree of recurvature in the bow limbs, as compared with the arrangements of FIGS. 6*a*, 6*b* and 6*c*, although in either event the bow limbs may be much more highly recurved than is practicable with any of the prior art archery bows.

Considering the structural arrangement of the bow of FIGS. 5*a*, 5*b* and 5*c*, it is noted that the bow here shown comprises a handle section generally indicated at 2, this handle section being generally arcuate, with a curved tension or front surface and with a back or compression surface 4 formed with a hand grip 5. An arrow notch 6 is arranged adjacent to the hand grip. The central hand grip region of the handle section is thicker than the end portions thereof, so that the hand grip is non-working, i.e. substantially rigid.

Curved bow limbs 7, 7 are joined with the ends of the handle section and are positioned to project forwardly of the bow, with the concave surfaces of the bow limbs presented towards each other. In the embodiments illustrated in FIGS. 5*a*, 5*b* and 5*c* the bow limbs are formed integrally with the handle section, but, as will be pointed out more fully hereinafter, these bow limbs may if desired be separately formed and fastened to the handle section.

The free end of each bow limb is provided with a nock for cooperation with an end of the bow string which is here indicated by the reference numeral 8.

From FIG. 5*b*, showing the bow in strung condition, it will be noted, that the bow limbs have extensive recurvature measured from the string line to a line tangent to the bow limb at the nock point. Thus, the bow of FIGS. 5*a*, 5*b* and 5*c* has an effective bow limb recurvature of 180° which is at least several times that possible or practicable with prior known forms of bows. When an arrow such as indicated at 9 in FIG. 5*c* is placed on the string and the string is drawn in preparation for shooting as in FIG. 5*c*, the major flexure or working of the bow occurs in the recurved bow limbs as is readily apparent from comparison of FIG. 5*c* with FIG. 5*b*.

In the embodiment of FIGS. 5*a*, 5*b* and 5*c*, elevated string guides are also preferably employed, one being applied to each of the recurved limbs. The string guide comprises a bracket member 10 having an aperture 11 for receiving the bow limb 7*a* Braces 12,12 fastened to the bracket member 10 served to maintain the bracket member in the desired up-standing position. The bracket member 10 also has a slot 13 which is open at its upper or free end and in which the bow string 8 is received. The bow string is thus laterally guided by the side walls of the slot 13, with the result that tendency for the bow limb to twist when the string is drawn is diminished. The location of this elevated string guide at a point spaced appreciably from the free end of the recurved limb, for instance at about the mid point of the 180° recurvature, is highly effective in increasing twist resistance.

The materials preferably employed in the construction of the improved bows of the present invention will be described more fully hereinafter, but the alternative form of construction shown in FIGS. 6*a*, 6*b* and 6*c* is first described as follows:

The bow of FIGS. 6*a*, 6*b* and 6*c* comprises a handle section generally indicated at 20, this handle section being generally arcuate, with a curved belly surface 21 and with a back surface formed with a hand grip 22, with an adjacent arrow notch 23. The central region of the handle section is thicker than the end portions.

Recurved bow limbs 24, 24 are fastened to the ends of the handle section 20, the limbs being positioned at the back side of the handle section with the concave sides of the limbs presented away from each other. The limbs are separately formed from the handle section and are fastened or mounted at the ends of the handle section by means of any suitable clamps such as indicated at 25. The free end of each bow limb is provided with a nock for cooperation with an end of the bow string 26. As will be seen from FIG. 6*a*, in the unstrung condition, the bow limbs constitute curved or arcuate members extending throughout about 270°. With the bow string attached as in FIG. 6*b*, the bow limbs are opened or flexed somewhat, so that the effective bow limb recurvature approximates 70° as is indicated in FIG. 6*b*.

As seen in FIG. 6*c*, when an arrow 27 is positioned for shooting and the bow string is drawn, the bow limbs 24 are further opened or flexed and comparison of FIGS. 6*b* and 6*c* will further show that as the arrow is shot, the return of the string to the position of FIG. 6*b* results in considerable shortening of the free length of the bow string, i.e., the length lying between the points of contact of the string with the outer surface of the recurved bow limbs.

In providing bows of the kinds described above, the invention contemplates the employment of certain materials having special characteristics adapted to make possible the use of highly recurved bow limbs while at the same time maintaining a high level of twist resistance. In considering the materials employed according to the present invention, it is first pointed out that modern reinforced plastic materials suitable for highly stressed surface layers of archery bow laminates have commonly employed parallel glass fibers, such as rovings, in a matrix of thermosetting polyester or epoxy resin. Such materials have excellent elastic recovery and good fatigue resistance and may be used not only as surface layers or skins for wood-cored sandwich composites, but also for solid bow construction. Such parallel glass laminates, however, have a high modulus of elasticity (for example 5,000,000 p.s.i.), as compared with wood, horn, or sinews, in view of which the bows produced of such glass laminates are necessarily relatively thin. The consequent relatively low twist resistance of the bow limbs places a severe limitation upon the extent to which the bow limbs may be recurved. Although some decrease in modulus may be attained by employment of glass fibers in woven or mat form, instead of rovings, the extent of this improvement is not very great and, in any event, such laminates lack fatigue resistance.

In accordance with the invention it is contemplated to employ reinforcement fibers in a resin matrix, which fibers have a much lower Young's modulus of elasticity, below 3,000,000 p.s.i., and preferably below 2,500,000 p.s.i., and which fibers further have at least 4% elongation and preferably upwards of about 5%. When employing such fibers it is possible to increase the thickness of the bow limbs sufficiently to provide a high degree of twist resistance even with bow limbs which are highly recurved. According to the invention the recurve is substantially greater than 45° for instance at least 55° and preferably upwards of about 60°. The degree of recurvature which is practicable to employ will depend upon certain factors related to the configuration of the bow. With bows of the type illustrated in FIGS. 5*a*, 5*b* and 5*c* a recurvature of at least 90° is preferred and it is even practicable as is illustrated to utilize a recurvature as high as 180° particularly if elevated string guides are employed. With bows of the general configuration of FIGS. 6*a*, 6*b* and 6*c*, it is not as practicable to attain as large a recurvature as in FIGS. 5*a*, 5*b* and 5*c*, but it is still practicable to employ a recurvature up to about 90°.

Calculations will show that even a relatively small increase in thickness of the bow limb will easily double the twist resistance of the limb. The increase in thickness of the bow limbs contemplated requires an increase in elongation of the materials at the surface of the bow limbs. For instance, a bow limb 0.500 inch thick recurved about 180° into a a 10 inches inside diameter, when bent out to straight line during draw, would require the tension surface to stretch 5%. Since this elongation is beyond the capability of many fibers with elastic recovery such as glass (3%), carbon, or graphite (1% or less), the invention contemplates employment of other reinforcement fibers, notably polyamide, saturated polyesterpolyamide blends and certain other fibers having not only good elastic recovery, but also high elongation (5 to 10%).

Certain specific fibers which are useful in accordance with the present invention are oriented fibers made of Nomex sold by DuPont Company (poly-hexamethylene adipamide); or from polyvinyl alcohol, as marketed by Kurarary Company, Saka, Japan; and polyamide-polyester blend as marketed by Allied Chemical, New York City, N.Y.

The resin matrix employed in the bow limbs should also have at least as much elongation as the reinforcing fibers. Although thermosetting unsaturated polyesters can be formulated to elongate sufficiently, they tend to loose some tensile strength and thermal resistance. Therefore the preferred matrix resins are epoxy resins. Examples of epoxy resin systems usable for low modulus laminates according to the invention are as follows (all parts by weight):

EXAMPLE 1

4 parts of resin — Shell 826 (epichlorohydrin/bisphenol A)

3 parts of hardener — Celenese Epicure 856 (amine hardener)

The above formulation will have about 10% tensile elongation.

EXAMPLE 2

100.0 parts of resin — Shell Epocryl Resin 21 (Styrenated bisphenol-A epoxy acrylate)

1.0 parts of catalyst — Benzoyl Peroxide

0.1. parts of activator — Dimethyl Aniline

This yields a composition having 5% tensile elongation.

Cured laminates containing about 40% by weight of the resin system and 60% by weight of parallel oriented polyhexamethylene-adipamide fibers, have a tangent flexural modulus of approximately 1,000,000 p.s.i. with maximum elongation varying according to the resin system used. Laminated highly recurved bow limbs may be prepared from these materials having increased thickness, thereby providing increased twist resistance. Laminates may also be used in which a low density core material, such as maple wood, is employed between belly and back surface layers of epoxy resin and reinforcing fibers of the kind above referred to. Such composite laminates have tangent flexural moduli of approximately 750,000, and are thicker with correspondingly increased twist resistance. Moreover such composite laminates have increasingly less shock force. Because this type of composite laminate permits design to the thickest, most twist resistant bow limbs, the composite type of structure provides maximum freedom for design of bow limbs recurved to a degree not heretofore possible. It will be understood that other material than maple wood may be used in the core of the composite laminate, for instance other woods, rigid foams and structural cores such as honeycombs.

It should be understood that for some bow limb arrangements the handle section of the bow may also contain materials which would flex or "work" in use of the bow, but with highly recurved bow limbs arranged in the manner described above, the employment of a working handle section is of secondary importance and, indeed, if desired, the handle section may be made more rigid than has been customary with most bows of the prior art. In a typical bow according to the invention, the recurved limbs may be formed of resin and fibers of the kinds referred to and the handle section may be formed of more conventional materials, such as polyester resins with glass fiber reinforcement.

Figure 7:
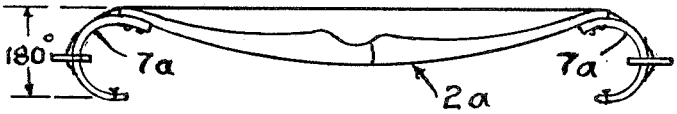

In bows of the present invention, the handle section and the bow limbs may be formed either integrally or separately. The bow limbs of bows having the general configuration of FIGS. 5*a*, 5*b* and 5*c* may readily be formed integrally with the handle section separately. The integral formation is illustrated in FIGS. 5*a*, 5*b* and 5*c* and the separate construction is illustrated in FIG. 7. In FIG. 7 the bow limbs 7*a* are formed separately and are fastened in any suitable manner to the handle section 2*a*. In this construction the bow limbs may be provided with attachment devices by which the position of the bow limbs with respect to the handle section may be adjusted. This may be accomplished by the type of adjustment devices described below in connection with FIGS. 8*a* to 11*a* which illustrate bows of the general configuration of FIGS. 6*a*, 6*b* and 6*c*.

Figure 8A:
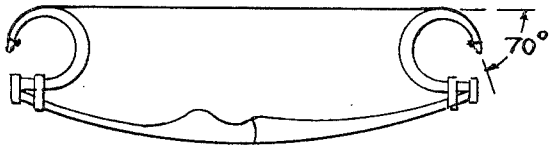
Figure 8B:
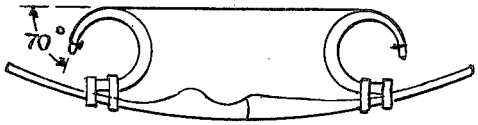

Such adjustable mounting of the bow limbs will provide freedom for variation in the operating characteristics of the bow. For instance, as shown in FIGS. 8 and 8*b*, the recurved limbs of the kind described above with reference to FIG. 6*a* may alternatively be mounted on the belly or the compression side of the bow either at the ends of the handle section (FIG. 8*a*) or in positions spaced somewhat inwardly from the ends of the handle section (FIG. 8*b*). For this purpose any suitable, releaseable clamping device may be utilized. In either position of adjustment the recurve will approximate 70° as in FIG. 6*b*.

Figure 9A:
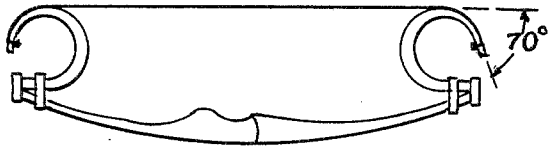
Figure 9B:
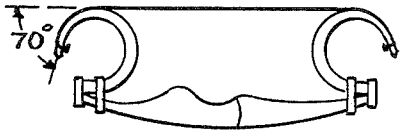

Figs. 9*a* and 9*b* illustrate another system for varying the characteristics obtainable with bow limbs of given construction. Here the bow limbs are alternatively mounted either at the ends of a relatively long handle section (FIG. 9*a*), or at the ends of a relatively short handle section (FIG. 9*b*), and again the recurve angle remains at about 70°.

Figure 10A:
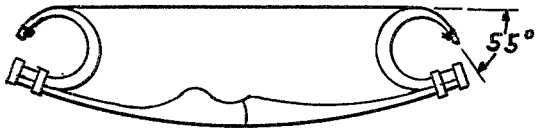
Figure 10B:
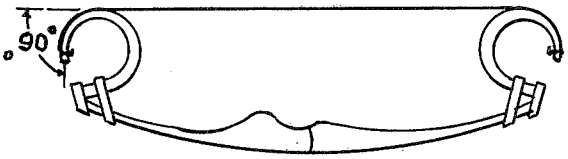

FIGS. 10*a* and 10*b* illustrate another system for varying the bow characteristics with the use of bow limbs of given design. Thus, in FIG. 10*a* the ends of the bow limbs which are fastened to the handle section are clamped in substantially parallel relation to the ends of the handle section, giving a recurve angle of about 55°, whereas in FIG. 10*b*, the clamping arrangement provides for holding the bow limbs in a different angular relation to the ends of the handle section, giving a recurve angle of about 90°.

Figure 11A:
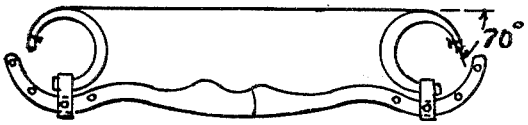
Figure 11B:
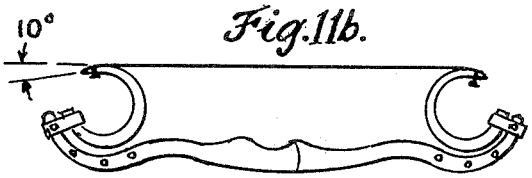

A change in angular relation between the recurved bow limbs and the ends of the handle section may also be provided for in accordance with the alternative arrangement illustrated in FIGS. 11*a* and 11*b*. The handle section employed in this embodiment has curved ends with bolting or clamping apertures provided at spaced points, so that the bow limbs may alternatively be connected in any one of a plurality of positions in the manner clearly indicated in FIGS. 11*a* and 11*b*. In this way, with a given bow limb design, the angle of recurvature may be varied all the way from about 10° to about 90°.

Thus any of a variety of techniques may be utilized for varying the characteristics of the bow, by shifting the position of mounting the separately formed bow limbs upon the ends of the handle section.

Figure 1A:
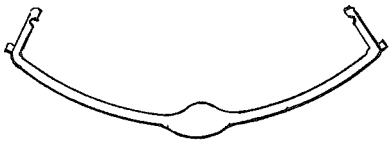
Fig. 1a. PRIOR ART
Figure 1B:
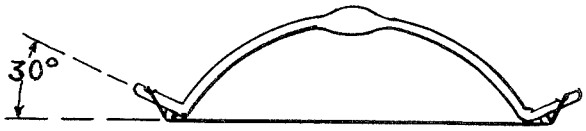
Fig. 1b. PRIOR ART
Figure 2A:
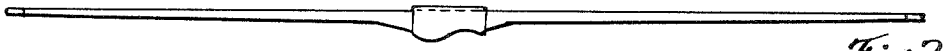
Fig. 2a. PRIOR ART
Figure 2B:
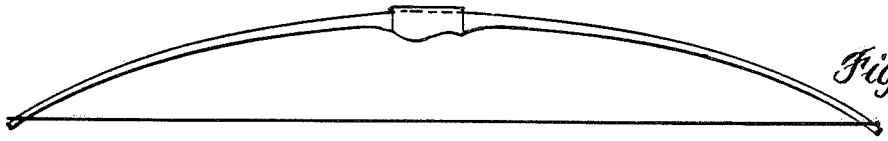
Fig. 2b. PRIOR ART
Figure 3A:
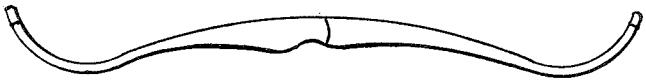
Fig. 3a. PRIOR ART
Figure 3B:
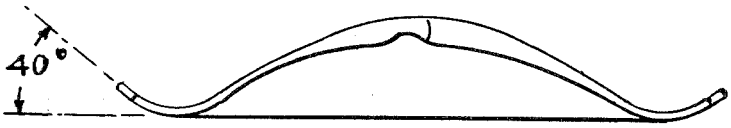
Fig. 3b. PRIOR ART
Figure 4A:
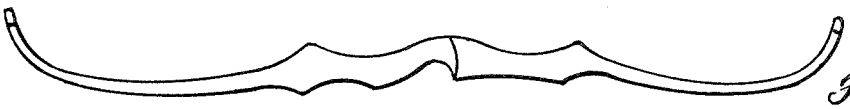
Fig. 4a. PRIOR ART
Figure 4B:
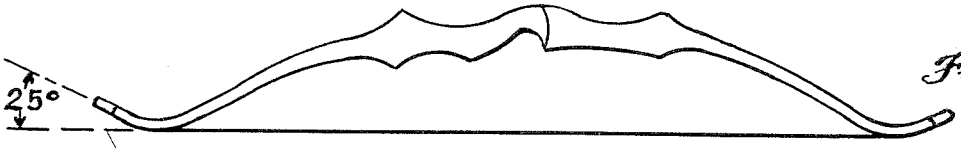
Fig. 4b. PRIOR ART

A bow constructed substantially in accordance with the arrangements illustrated in FIGS. 5*a*, 5*b* and 5*c* and having a bow limb recurve of about 180° was comparatively tested with two prior art bows, one substantially conforming with the general configuration shown in FIGS. 4*a* and 4*b* and the other conforming with the general configuration shown in FIGS. 2*a* and 2*b*. The results of these comparative tests have been plotted on the graph or chart of FIG. 21 which clearly shows a striking improvement in the force-draw curve of the bow of the present invention as compared with the prior art bows. In the graph the lined or shaded areas underlying the curves represent the total force available for shooting the arrow, and it will be seen that the bow of the present invention is markedly improved in this respect, notwithstanding the fact that the draw force required to maintain the string in the full drawn position is the same with each of the three bows comparatively tested.

Fabricating Method:

Although the bow limbs may be formed or molded integrally with the handle section in the bow of FIGS. 5*a*, 5*b* and 5*c*, certain constructional advantages may be realized by forming the bow limbs separately from the handle section as in FIG. 7 and also in FIGS. 6*a*, 6*b* and 6*c*. A method for separate formation of the bow limbs is illustrated diagrammatically in FIGS. 12 to 20.

In FIG. 12 there is disclosed a mandrel generally indicated at 28, the mandrel preferably being hollow and being provided with hollow shafts 29, 29 which serve to mount the mandrel for rotation and may also provide for circulation of a heating medium for the purpose of curing resin applied to the mandrel, as will be further described.

The mandrel 28 has an axial slot at one side indicated at 30 and the mandrel also preferably has flatted surfaces 31, 31 adjacent to the slot 30. Before positioning the mandrel for rotation in the filament winding equipment, a strip or tape, for instance cloth or resin tape 32 is applied over the slot 30 so that when resin impregnated strands or filaments are wound on the mandrel, the resin will not enter the slot. A parting compound or film may also be applied to the mandrel.

As seen in FIG. 13, fibrous strands such as indicated at 33 may be fed from one or more sources of supply indicated at 34 and directed through a bath or reservoir of liquid resin material in the resin pan 35. Upon emergence from the resin bath the strand may pass through an apertured guide or the like indicated at 36 provided for regulation of the quantity of the liquid resin carried by the reinforcement strand. The strand may then pass to and through a traverse guide 37 adapted to move axially of the mandrel 28 as the mandrel rotates in order to distribute the impregnated reinforcement along the mandrel. In this way a layer or skin is built up. It will be understood that the illustration in FIG. 13 is diagrammatic and that any of a variety of known forms of filament winding equipment may be employed for the present purposes.

In the preferred practice of the invention an initial layer of fiber reinforced resin material is applied on the mandrel and thereafter, a core element 38 is wrapped around the mandrel as indicated in FIG. 13. The core may comprise a wood structure, such as maple wood. The thickness of the core is desirably tapered, as is illustrated in FIGS. 14 to 17.

After application of the core another layer of fiber reinforced resin material is applied, the reinforcement for this layer being indicated in FIG. 15 at 39. This may be applied in the same manner as illustrated in FIG. 13. This outer layer of fiber reinforced resin material will serve to form the belly skin of the bow limbs being made.

A plastic or metal sheet 40 may then be wrapped around the mandrel and clamped as indicated at 41, so as to retain the various layers of the laminate in place during the subsequent curing operation. As seen in FIG. 17 the entire structure including the mandrel may be placed within an oven such as indicated at 42 for resin curing purposes. For purposes of effecting curing, a heating medium may also be circulated through the hollow shafts 29, or if desired both internal and external heating may be utilized.

When the tubular structure being made has been cured and solidified, the jacket 40 is removed and, as illustrated in FIG. 18, a cut is then made as by means of a saw operating at the axial plane of the slot 30, thereby permitting opening of the tubular structure formed sufficiently to withdraw the mandrel with ease. The tubular structure 43 formed in this manner is also fragmentarily illustrated in FIG. 19.

Bow limbs such as shown at 44 in FIG. 20 are then cut from the tube 43, by making generally transverse cuts, preferably in planes which will provide a bow limb which is tapered not only in thickness but also in width as is plainly shown in FIG. 20.

I claim:

1. An archery bow comprising; a handle section with a hand grip positioned substantially intermediate the ends thereof the ends of said handle section projecting a substantial distance in opposite directions from the hand grip, thereof and bow limbs each comprising an arcuate member and having a concave configuration with one end thereof connected to the handle section and the other end thereof having a nock for receiving an end of a bow string, the limbs being connected to compression side of the handle section with the concave sides of the limbs presented away from each other.

2. A bow as defined in claim 1 and further including adjustable means providing for connection of the limbs to the handle section alternatively in different positions with respect to the bow.

3. A bow as defined in claim 2 in which the adjustable means provides for connecting the limbs to the handle section at different inter-limb spacings.

4. A bow as defined in claim 2 in which the adjustable means provides for connection of the limbs with the handle section in different angular positions with respect to the handle section.

* * * * *